US009660362B2

(12) United States Patent
Grumel

(10) Patent No.: US 9,660,362 B2
(45) Date of Patent: May 23, 2017

(54) DEVICE FOR ELECTRICAL CONNECTION HAVING AN AUXILIARY OUTPUT, AND SWITCHING APPLIANCE HAVING SUCH A DEVICE

(71) Applicant: Schneider Electric Industries SAS, Rueil Malmaison (FR)

(72) Inventor: Christophe Grumel, Lans En Vercors (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/950,135

(22) Filed: Nov. 24, 2015

(65) Prior Publication Data

US 2016/0164200 A1 Jun. 9, 2016

(30) Foreign Application Priority Data

Dec. 8, 2014 (FR) ..... 14 62022

(51) Int. Cl.
*H01H 67/02* (2006.01)
*H01R 11/07* (2006.01)
(Continued)

(52) U.S. Cl.
CPC ..... *H01R 11/07* (2013.01); *H01H 71/08* (2013.01); *H01R 4/38* (2013.01); *H01H 9/0264* (2013.01);
(Continued)

(58) Field of Classification Search
CPC ..... H01H 50/546
(Continued)

(56) References Cited

U.S. PATENT DOCUMENTS 3,655,934 A * 4/1972 Turnbull ..... H01H 1/2008 200/268
3,775,733 A * 11/1973 Ege ..... H01R 9/2491 439/712
(Continued)

FOREIGN PATENT DOCUMENTS

| | | |
|---|---|---|
| FR | 2 687 248 A1 | 8/1993 |
| FR | 2 707 429 A1 | 1/1995 |
| WO | WO 97/22986 A1 | 6/1997 |

OTHER PUBLICATIONS

French Preliminary Search Report issued Jul. 24, 2015 in French Application 14 62022, filed on Dec. 8, 2014 (with English Translation of Categories of Cited Documents).

*Primary Examiner* — Alexander Talpalatski
(74) *Attorney, Agent, or Firm* — Oblon, McClelland, Maier & Neustadt, L.L.P.

(57) ABSTRACT

A device connects an electrical conductor to an area for electrical connection of an electrical switching device, the switching device having an electrical switching module connected to the area for electrical connection. The connecting device has at least one primary unit for electrically connecting a primary conductor to the area for connection, and an insulating shell receiving each primary connecting unit. The connecting device additionally has at least one secondary unit for connecting a secondary electrical conductor, and, for each secondary unit, an electrically conductive link piece connected between the secondary unit and a respective primary unit.

15 Claims, 4 Drawing Sheets

(51) Int. Cl.

| | |
|---|---|
| ***H01R 4/38*** | (2006.01) |
| ***H01H 71/08*** | (2006.01) |
| *H01R 103/00* | (2006.01) |
| *H01H 9/02* | (2006.01) |
| *H01H 71/02* | (2006.01) |
| *H01R 4/30* | (2006.01) |
| *H01R 4/36* | (2006.01) |
| *H01R 13/447* | (2006.01) |

(52) U.S. Cl.
CPC ..... *H01H 71/0228* (2013.01); *H01R 4/302* (2013.01); *H01R 4/36* (2013.01); *H01R 13/447* (2013.01); *H01R 2103/00* (2013.01)

(58) Field of Classification Search
USPC ..... 335/131, 202
See application file for complete search history.

(56) References Cited

U.S. PATENT DOCUMENTS 3,796,978 A * 3/1974 Grunert ..... H01H 50/546 335/142
3,964,006 A * 6/1976 Lacan ..... H01H 50/546 335/132
4,513,269 A * 4/1985 Miyamoto ..... H01H 50/546 200/1 V
5,107,396 A 4/1992 Rosen et al.
5,978,208 A * 11/1999 Helms ..... H01H 1/5855 200/284
6,572,418 B2 * 6/2003 Takaya ..... H01R 4/363 439/411
6,781,491 B2 * 8/2004 Whipple ..... H01R 31/06 335/202
7,132,913 B2 * 11/2006 Whipple ..... H01H 11/0031 335/202
7,609,137 B2 * 10/2009 Roesner ..... H01H 71/08 200/293
7,679,477 B2 * 3/2010 Portier ..... H01H 50/443 220/3.2
7,798,868 B2 * 9/2010 Borona ..... H01R 4/305 335/202
2003/0076204 A1 4/2003 Whipple et al.
2011/0183552 A1 7/2011 Skowranek

* cited by examiner

DEVICE FOR ELECTRICAL CONNECTION HAVING AN AUXILIARY OUTPUT, AND SWITCHING APPLIANCE HAVING SUCH A DEVICE

The present invention concerns a removable connecting device adapted to connect a conductor electrically and mechanically to a connection area of an electrical switching device including an electrical switching module connected to the connection area and an auxiliary module. The removable connecting device includes at least one primary unit for connecting a primary connector to the connection area, an insulating shell receiving a respective primary connecting unit, and adapted to insulate electrically the primary connecting unit from the outside of the connecting device when the primary conductor is connected to the corresponding area. The connecting device also includes means for fixing the shell to the switching device.

The invention also concerns a circuit-breaker equipped with at least one connecting device in accordance with the invention.

There is known from the document FR 2 687 248 A1 a removable connecting device of the aforementioned type. That device includes a unit for connecting a conductor to a connection area of an electrical switching device. Such a device enables the connecting unit to be electrically insulated from the outside when the conductor is connected to the area of the electrical switching device. Moreover, this device is provided with fixing members that enable it to be fixed to the switching device and the electrical connection between the conductor and the area is assured. The fixing of the connecting device to the switching device is simple, effected manually and requires no specific tool. Similarly, demounting the connecting device is easy, which facilitates intervention by operators. Moreover, in the case of a multipole circuit-breaker, use of such a connecting device is appropriate for the connection of any of the conductors to any of the connection areas.

Such switching devices are often completed by adding auxiliary modules that provide additional functions. These functions are, for example, functions that signal the status of the switching device. In the case of a circuit-breaker, an auxiliary module is also adapted to signal tripping of the circuit-breaker following the occurrence of an electrical fault. Such modules generally necessitate an electrical power supply. In order to assure operation of the auxiliary module even when the switching device cuts off the current, the supply of power to the auxiliary module is generally obtained by connecting the auxiliary module to the input conductor of the switching device. In most cases this connection is obtained by conjointly inserting the input conductor and the power supply conductor into the same connecting unit.

However, connecting the power supply conductor to the input conductor is relatively difficult and does not always enable a reliable and reproducible electrical connection to be produced between the two conductors.

The object of the invention is therefore to propose a removable device for connecting a primary conductor to a corresponding connection area of an electrical switching device including an auxiliary module that enables easier connection of a secondary conductor intended to supply power to the auxiliary module, at the same time as improving the electrical connection of the power supply conductor to the input conductor.

To this end, the invention consists in a connecting device of the aforementioned type further including:

at least one secondary unit for connecting a secondary electrical conductor adapted to supply electrical power to the auxiliary module, and for each secondary unit, an electrically conductive link piece connected between said secondary unit and a respective primary unit, the insulating shell further receiving each secondary unit and each link piece and being adapted to insulate electrically each secondary unit from the outside of the connecting device when the secondary conductor is connected to the secondary unit.

In accordance with other advantageous aspects of the invention, the connecting device has one or more of the following features, separately or in any technically feasible combination:

each primary unit includes a primary cage including a primary clamping wall and a primary mobile clamping plate adapted to clamp a respective primary conductor against the primary clamping wall;

the primary cage includes primary means for clamping the primary clamping plate, the clamping means being mobile between a primary unclamped position in which the primary conductor is mobile relative to the primary cage and a primary clamped position in which the primary clamping plate is configured to clamp the primary conductor against the primary clamping wall, and the connecting device further includes means for retaining the primary clamping means in the primary unclamped position in the absence of activation of the primary clamping means;

the primary clamping means include a retaining portion co-operating with at least one flexible branch of the retaining means to retain the primary clamping means in their primary unclamped position;

each secondary unit includes a secondary cage including a secondary clamping wall and secondary mobile clamping means adapted to clamp their respective secondary conductor against the secondary clamping wall;

each secondary unit includes a secondary cage including a secondary clamping wall and secondary mobile clamping means adapted to clamp their respective secondary conductor against the secondary clamping wall, the primary clamping plate and the secondary clamping means are movable independently of each other;

the link piece includes a primary connecting tongue adapted to be disposed between the primary conductor and the primary clamping wall and a secondary connecting tongue adapted to be disposed between the secondary conductor and the secondary clamping means;

the primary tongue and the secondary tongue are oriented in opposite directions;

each primary unit includes a primary opening configured to receive a respective primary conductor and primary removable means for partially blocking the primary opening, the primary blocking means preferably being adapted to prevent the insertion of objects having a section of greater than 12.5 mm diameter into the primary opening;

each secondary unit includes a secondary opening configured to receive a respective secondary conductor and secondary means for partially blocking the secondary opening;

the secondary blocking means are mobile between a blocking position preventing the insertion of objects into the secondary opening and an open position enabling the insertion of objects into the secondary opening; and the connecting device is manually removable from the electrical switching device.

The invention also consists in an electrical switching appliance provided with at least one area for connecting an electrical conductor and a switching device as defined above.

In accordance with other advantageous aspects of the invention, the switching appliance has one or more of the following features, separately or in any technically feasible combination:

the electrical switching device is a circuit-breaker; and the switching device further includes an auxiliary module, the auxiliary module being electrically connected to the corresponding secondary unit via the corresponding secondary conductor.

These features and advantages of the invention will become apparent on reading the following description given by way of non-limiting example only and with reference to the appended drawings, in which:

FIG. 1 is a perspective view of a switching device including an electrical connection area, an electrical switching module and an auxiliary module, the switching device being provided with connecting devices in accordance with the invention each including a primary unit for connecting a primary conductor to a corresponding connection area of the switching device, a secondary unit for connecting a secondary connector, an insulating shell receiving the primary units and the secondary units and adapted to insulate them electrically from the outside, and means for fixing the shell to the switching device;

Figure 1:
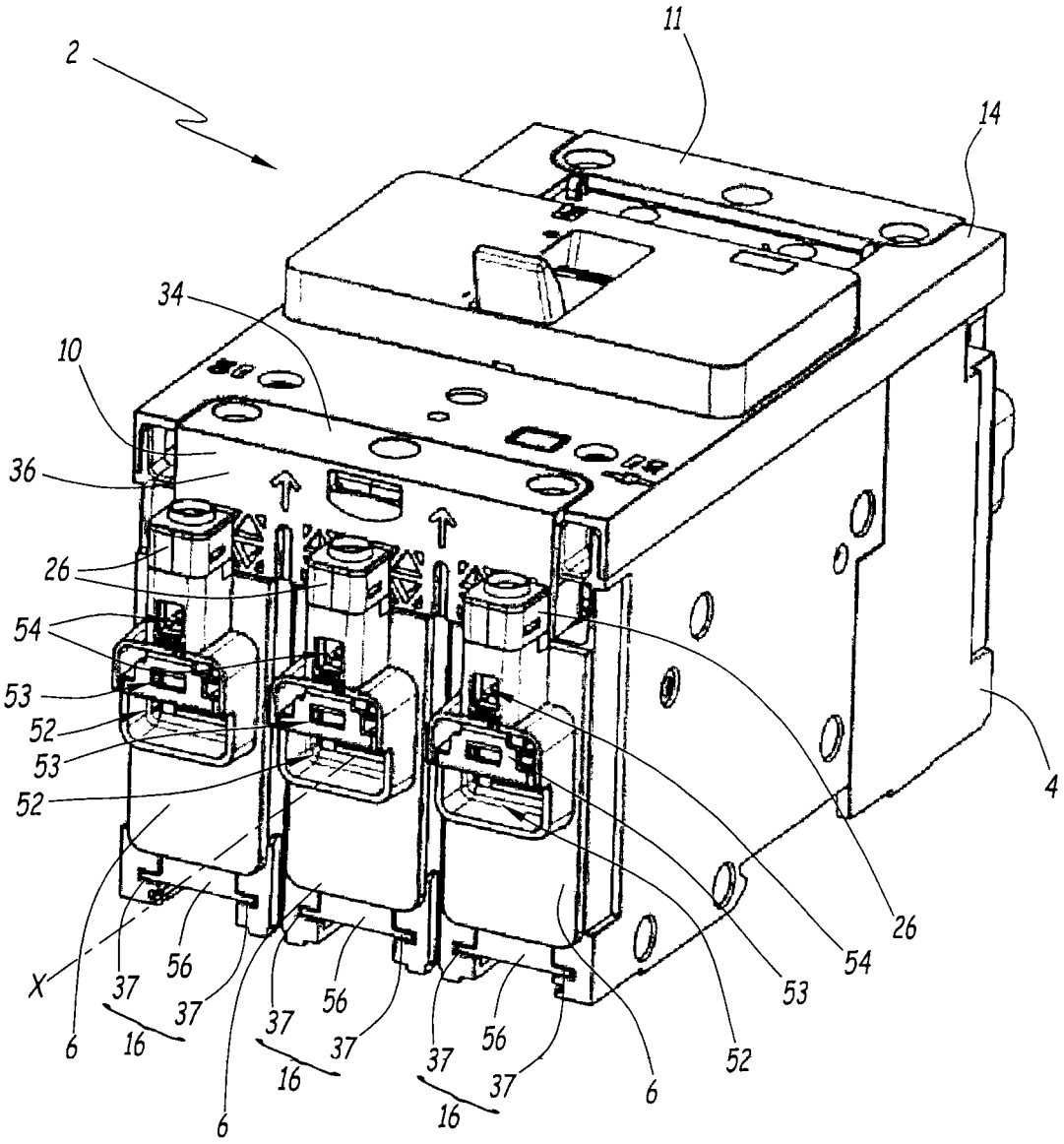

In FIG. 1, a switching appliance 2 includes an electrical switching device 4 and six devices 6 for connecting a primary conductor 8 to the switching module 4. The switching appliance 2 includes a first element 10 for fixing at least one connecting device 6 to the switching device 4 and a second element 11 for fixing at least one other connecting device 6 to the switching device 4.

The switching device 4 includes a switching module (not shown), an auxiliary module (not shown), at least one input connection area 12, at least one output connection area (not shown), a protective cover 14, and members 16 for fixing each connecting device. The switching device 4 is configured to receive a current I in the input connection areas 12 and to deliver the current I in the output connection areas, each connection area being intended to be electrically connected to a corresponding primary conductor.

The switching device 4 is known in itself. The switching device 4 is an electromechanical circuit-breaker, for example. In FIG. 1, the switching device 4 is a three-phase circuit-breaker provided with three input connection areas 12 and three output connection areas.

Figure 2:
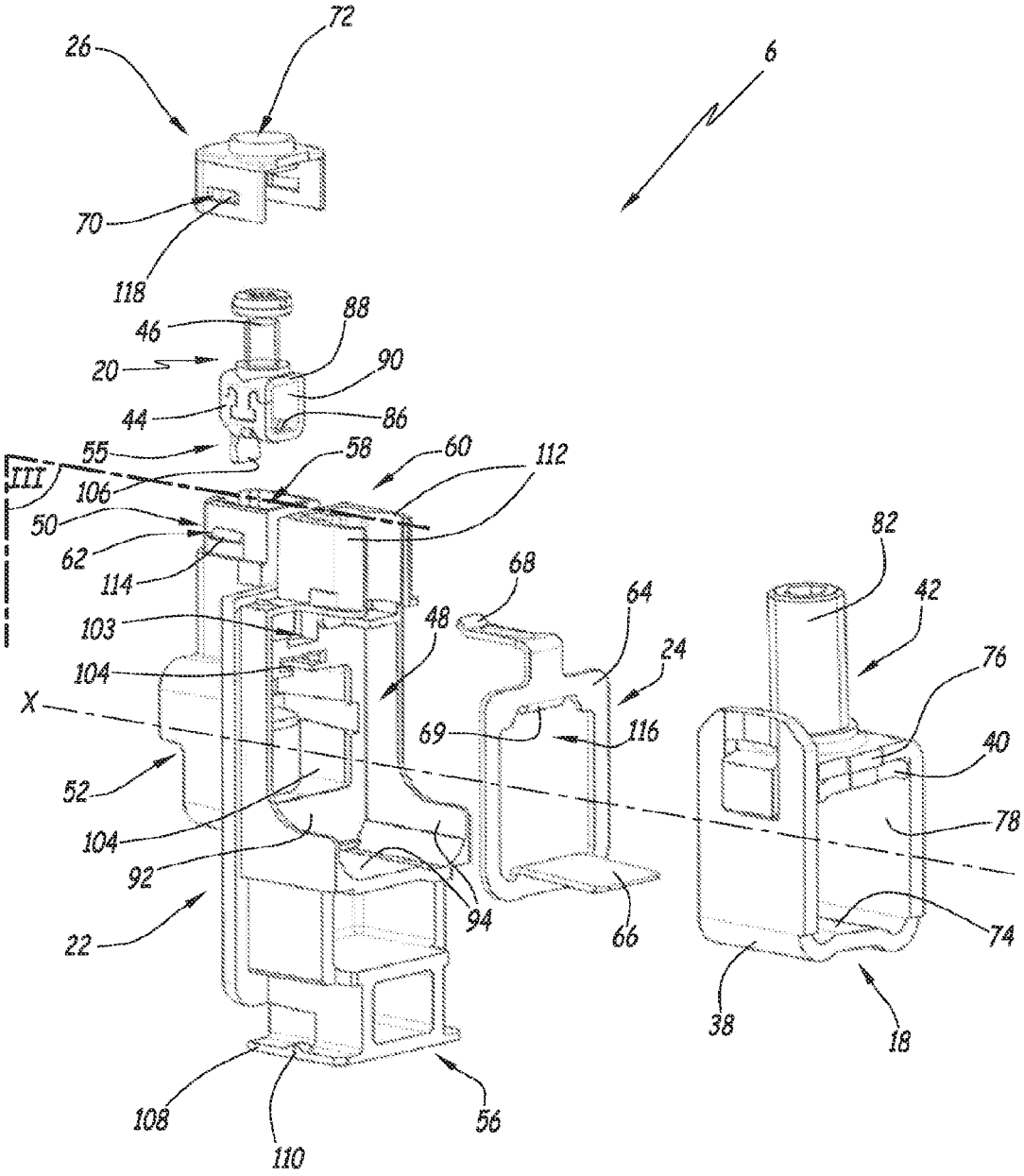
FIG. 2 is an exploded view of the connecting device from FIG. 1.

In FIG. 2, each connecting device 6 includes a primary unit 18 for connecting a primary conductor, a secondary unit 20 for connecting a secondary conductor, an insulating shell 22, an electrically conductive link piece 24 for connecting the primary unit 18 to the secondary unit 20 and a cap 26 for insulating the secondary unit 20.

The connecting device 6 is removable from the switching device 4, preferably manually removable. For example, the connecting device 6 is configured to be inserted into the switching device 4 by sliding it in an insertion direction X.

The connecting device 6 is adapted to connect electrically the primary conductor 8 to a respective input connection area 12 or output connection area of the switching device 4 when the connecting device 6 is fixed to the switching device 4.

The connecting device 6 is also adapted to connect electrically a secondary conductor 28 to a respective primary conductor 8 via the link piece 24, the primary conductor 8 being connected to an input connection area 12 or to an output connection area.

The primary conductor 8 is known in itself. For example, the primary conductor 8 includes a copper core 30 and an insulating sheath 32, both visible in FIG. 4.

Each fixing element 10, 11 is adapted to cooperate with the insulating shell 22 to fix the corresponding connecting device 6 to the switching device 4 in conjunction with the fixing members 16. In FIG. 1, the fixing element 10 includes an attachment portion 34 adapted to be fixed to the switching device 4 and a retaining plate 36 adapted to cooperate with the connecting device 6. For example, the attachment portion 34 is fixed to the switching device 4 by screws (not shown). Alternatively, the attachment portion 34 is clipped to the switching device 4. The retaining plate 36 is perpendicular to the attachment portion 34. The attachment portion 34 and the retaining plate 36 are in one piece, for example.

In FIG. 1, each fixing element 10, 11 is adapted to fix three connecting devices 6 to the switching device 4 simultaneously. In a variant that is not shown, the switching device 4 includes three first fixing elements 10 and three second fixing elements 11, each fixing element 10 being adapted to fix a respective connecting device 6 to the switching device 4.

The switching module is known in itself. The switching module is adapted to cut off the transmission of the current I between the input connection areas 12 and the output connection areas.

The auxiliary module is known in itself. For example, the auxiliary module is a module for signalling the status of the switching device adapted to communicate with a remote electronic device. Alternatively, the auxiliary module is a module for signalling tripping on a fault. For example, the auxiliary module is supplied with power via a corresponding secondary conductor 28.

The protective cover 14 is adapted to cover the switching module and the auxiliary module.

The fixing members 16 are configured to fix each connecting device 6 to the switching device 4 in conjunction with the fixing element 10, 11, in a position enabling connection of a primary conductor to an input connection area 12 or an output connection area.

The fixing members 16 are clipping members, for example. The fixing members 16 have shapes complementary to the shell 22. In FIG. 1, the fixing members 16 include two slots 37.

In a variant that is not shown, the fixing members 16 includes screws and complementary threaded holes.

The primary connecting unit 18 is adapted to maintain the primary conductor 8 electrically connected to the input connection area 12 or the output connection area.

In FIG. 2, the primary unit 18 includes a primary connecting cage 38, a primary clamping plate 40 and primary clamping means 42.

The secondary connecting unit 20 is configured to maintain a secondary conductor 28 electrically connected to the respective link piece 24.

In the FIG. 2 example, the secondary unit 20 includes a secondary connecting cage 44 and secondary clamping means 46.

The insulating shell 22 receives each primary unit 18 and each secondary unit 20. The insulating shell 22 is adapted to insulate each primary unit 18 from the outside when the connecting device 6 is fixed to the switching device 4 and when the respective primary conductor is connected to said primary unit 18. The insulating shell 22 is adapted to insulate each secondary unit 20 from the outside when the connecting device 6 is fixed to the switching device 4 and the secondary conductor 28 is connected to said secondary unit 20. The insulating shell 22 is made in one piece, for example. The insulating shell 22 is made from an electrically insulative material. The insulating shell 22 is made from a plastics material, for example.

For example, the shell 22 includes a primary chamber 48 to receive the primary unit 18, a secondary chamber 50 to receive the secondary unit 20, a primary opening 52 for inserting the corresponding primary conductor 8, primary means 53 for partially blocking the primary opening 52, a secondary opening 54 for inserting the corresponding secondary conductor 28 into the secondary chamber 50, removable secondary means 55 for partially blocking the secondary opening 54, and means 56 for fixing it to the switching device 4.

The shell 22 further includes an upper opening 58 for inserting the corresponding secondary unit 20 into the secondary chamber 50, means 60 for retaining the primary clamping means 42 in the absence of activation of these clamping means 42 and the attachment members 62 of the insulating cap 26.

The link piece 24 electrically connects the primary unit 18 to the respective secondary unit 20. The link piece 24 is made from an electrically conductive material, for example. The link piece 24 is made of metal, for example.

Figure 3:
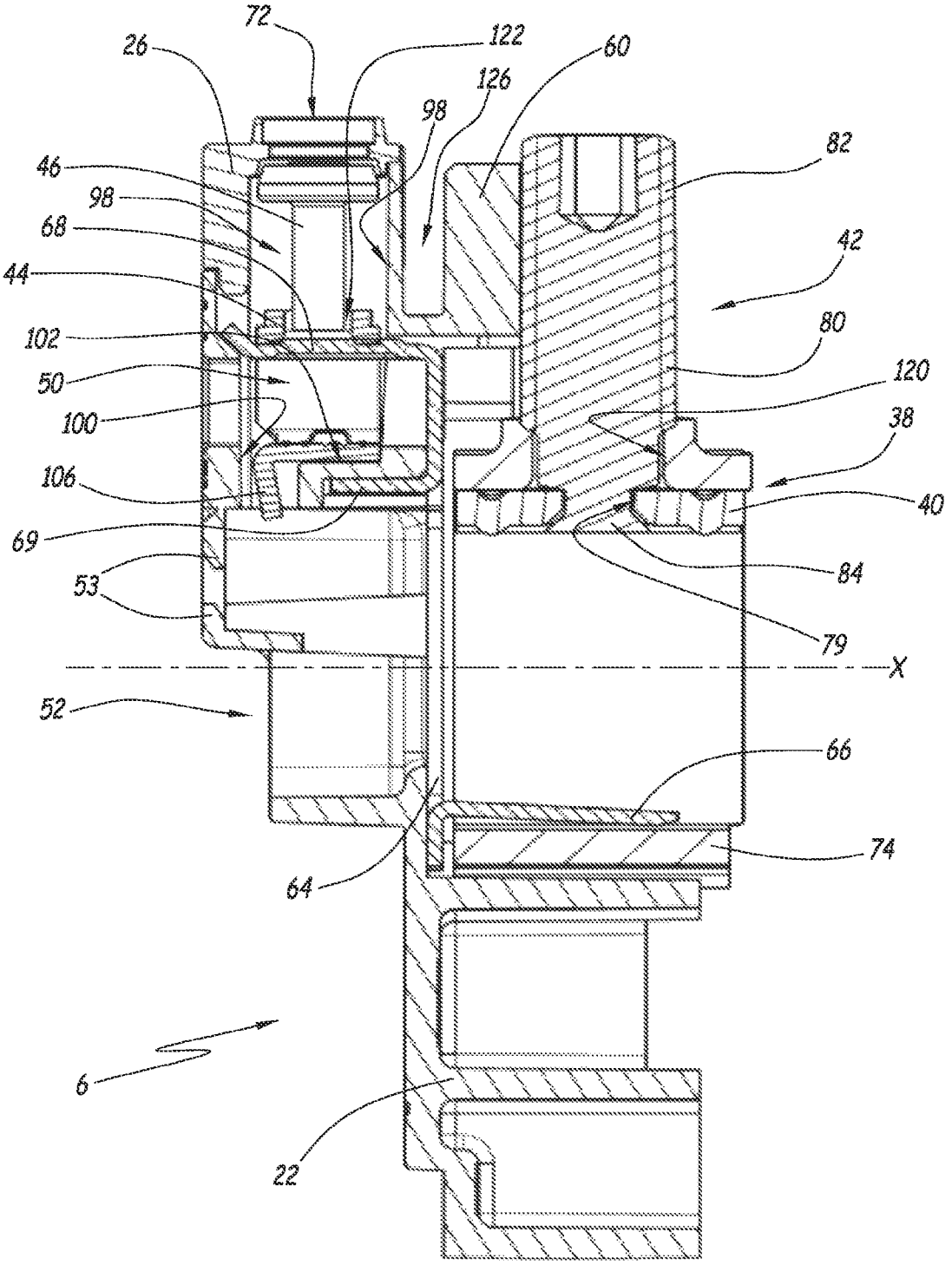
FIG. 3 is a sectional view on the plane III in FIG. 2.

In FIG. 3, the link piece 24 includes a portion 64 bearing against the insulating shell 22, a primary tongue 66, a secondary tongue 68 and a positioning tongue 69. The bearing portion 64, the primary tongue 66, the secondary tongue 68 and the positioning tongue 69 are made in one piece, for example.

The insulating cap 26 is configured to be fixed to the insulating shell 22 and 26 includes attachment elements 70 configured to cooperate with the attachment members 62.

The insulating cap 26 is adapted to block partially the upper insertion opening 58. Partial blocking allows the passage of a tool (not shown) for actuating the secondary clamping means 46. For example, the insulating cap 26 includes an actuating opening 72 allowing the insertion of the tool for actuating the secondary clamping means 46, such as a screwdriver.

The secondary conductor 28 is adapted to supply electrical power to the auxiliary module. The secondary conductor 28 is adapted to be connected between the auxiliary module and the connecting device 6. The secondary conductor 28 is a copper wire, for example.

Figure 4:
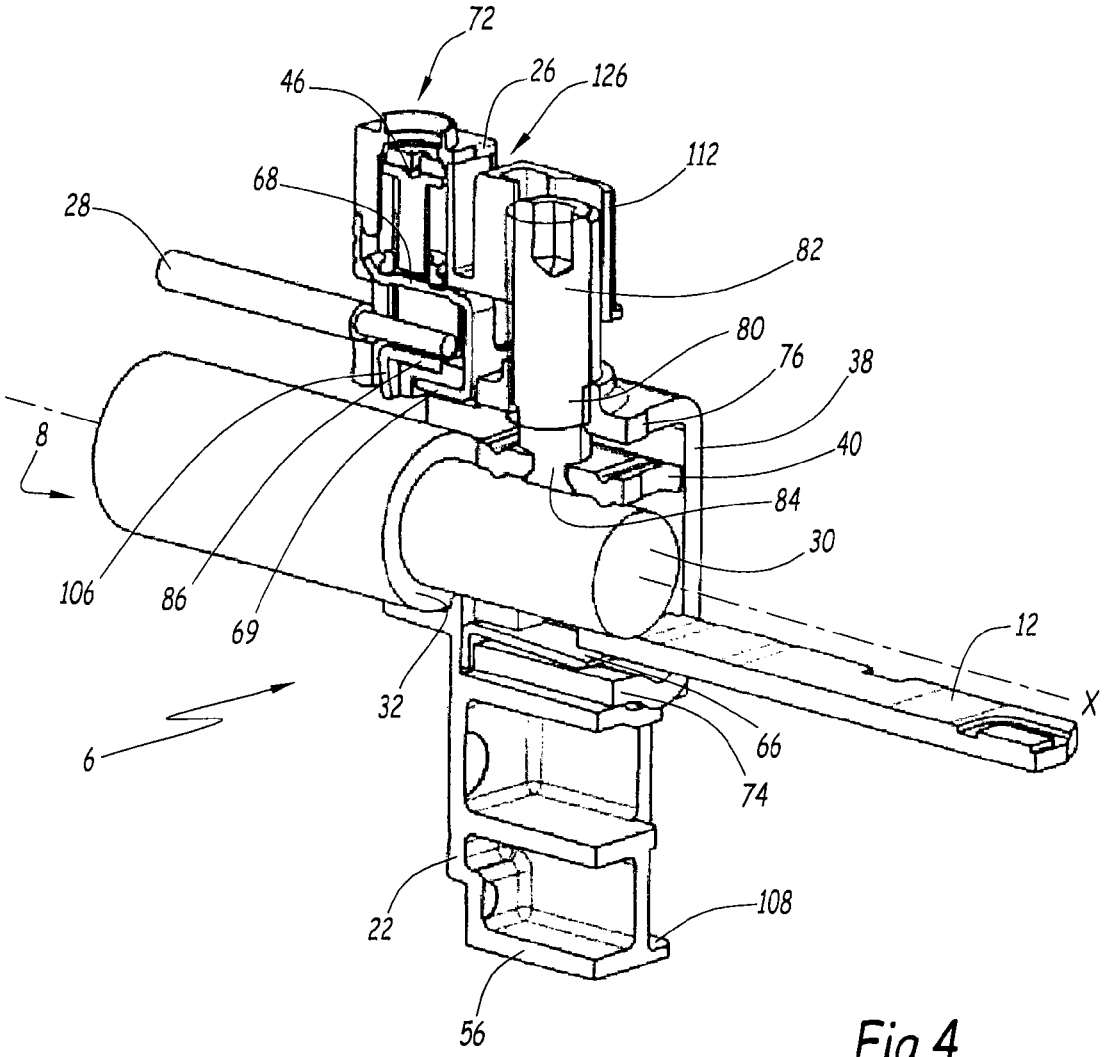
FIG. 4 is a view in partial section on the plane III of the connecting device from FIGS. 2 and 3, with a primary connector inserted in the primary unit and a secondary connector inserted in the secondary unit.

The primary connecting cage 38 is adapted to receive the primary conductor 8, the respective primary tongue 66 and the input connection area 12 or the output connection area, as shown in FIG. 4. In the FIG. 2 example, the primary cage takes the form of a cylinder with a rectangular base.

The primary cage 38 includes a primary clamping wall 74, a primary screwing wall 76 facing the primary clamping wall 74 and two primary lateral walls 78.

The primary cage 38 receives the primary clamping plate 40 and the primary clamping means 42. In particular, the primary clamping means 42 are carried by the primary screwing wall 76.

The primary cage 38 is made in once piece, for example. In accordance with the FIG. 2 example, the primary cage 38 is made in one piece bent on itself. The primary cage 38 is preferably made from an electrically conducting material, such as a metal.

The primary clamping plate 40 is mobile in translation between the primary screwing wall 76 and the primary clamping wall 74. The primary clamping plate 40 cooperates with the primary clamping means 42 to be moved in translation. In FIG. 3, the primary clamping plate 40 includes a complementary opening 79.

The primary clamping means 42 are configured to drive the movement in translation of the primary clamping plate 40 between the primary screwing wall 76 and the primary clamping wall 74 when they are actuated, for example by means of a tool, such as a screwdriver. In particular, the primary clamping means 42 are configured to drive the movement in translation of the primary clamping plate 40 between a primary unclamped position in which the primary clamping plate 40 is in contact with the primary screwing wall 76 and a primary clamped position in which the primary clamping plate 40 is pressed against the primary clamping wall 74. The primary clamping means 42 are adapted to command the clamping of the primary conductor 8 between the primary clamping plate 40 and the primary clamping wall 74 when a primary conductor 8 is inserted in the primary cage 38. According to the FIG. 2 example, the primary clamping means 42 include a screw having a threaded portion 80, a retaining portion 82 and an end 84.

The secondary cage 44 is adapted to receive the secondary conductor 28 and the respective secondary tongue 68. In accordance with the FIG. 2 example, the secondary cage takes the form of a cylinder with a rectangular base. The secondary cage 44 includes a secondary clamping wall 86, a secondary screwing wall 88 facing the secondary clamping wall 86 and two secondary lateral walls 90.

The secondary cage 44 receives the secondary clamping means 46. In particular, the secondary clamping means 46 are carried by the secondary screwing wall 88.

The secondary cage 44 is made in one piece, for example. In accordance with the FIG. 2 example, the secondary cage 44 is made in one piece bent on itself. The secondary cage 44 is preferably made from an electrically conductive material, such as a metal.

The secondary clamping means 46 bear against the secondary tongue 68. The secondary clamping means 46 are adapted to move the secondary cage 44 between a secondary unclamped position in which the secondary tongue 68 is in contact with the secondary screwing wall 88 and a secondary clamped position in which the secondary tongue 68 is in contact with the secondary clamping wall 86. The secondary clamping means 46 are adapted to command the clamping of the secondary conductor 28 between the secondary clamping wall 86 and the secondary tongue 68 when a secondary conductor 28 is inserted into the second cage 44. In accordance with FIG. 2, the secondary clamping means 46 include a screw, for example.

The primary chamber 48 includes a primary transverse wall 92 substantially perpendicular to the direction of insertion of the primary conductor 8 and four primary lateral walls 94 extending substantially perpendicularly from the primary transverse wall 92.

In FIG. 3, the secondary chamber 50 includes three secondary lateral walls 98, a secondary transverse wall 100 and an abutment wall 102.

In accordance with the FIG. 2 example, the secondary chamber 50 communicates with the primary chamber 48 via a connection opening 103 adapted to enable insertion of the secondary tongue 68 into the secondary chamber 50. The connection opening 103 is in the secondary lateral wall 98 facing the secondary transverse wall 100, for example.

The primary opening 52 is configured to enable the insertion of the primary conductor 8 into the primary chamber 48 in a primary insertion direction. The primary insertion direction is parallel to the insertion direction X, for example. The primary opening 52 extends between the primary transverse wall 92 and the outside. The primary opening 52 includes a slide 104 for positioning the link piece 24. The primary blocking means 53 are configured to block the primary opening 52 at least partially. The primary blocking means 53 preferably prevent the insertion of objects having a diameter greater than 12.5 mm through the primary opening 52. The primary blocking means 53 are preferably removable, more preferably adapted to be broken off.

In FIG. 3, the primary blocking means 53 are in one piece with the shell 22.

The secondary opening 54 is configured to enable the insertion of the secondary conductor 28 into the secondary chamber 50 in a secondary insertion direction. The secondary insertion direction is preferably parallel to the primary insertion direction. The secondary opening 54 extends between the secondary transverse wall 100 and the outside.

The secondary blocking means 55 are configured to block the secondary opening 54 at least partially. For example, the secondary blocking means 55 include a blocking tongue 106 in one piece with the secondary cage 44. The blocking tongue 106 extends downward from the secondary clamping wall 86, for example.

In a variant that is not shown, the secondary blocking means 55 include a portion adapted to be broken off in one piece with the insulating shell 22.

The fixing means 56 are adapted to fix the shell 22 to the switching device 4 in a reversible manner, an operator being able to act on the fixing means 56 to detach the shell 22 from the switching device 4.

The fixing means 56 are clipping means, for example. The fixing means 56 preferably have shapes complementary to the fixing members 16. In FIG. 2, the fixing means 56 include two rims 108 in one piece with the shell 22. Each rim 108 includes a projecting clip 110.

In a variant that is not shown, the fixing means 56 are screw fixing means.

The retaining means 60 are configured to immobilize the primary clamping means 42 in the absence of action on the part of the operator. In particular, the retaining means 60 are configured to prevent movement of the primary clamping plate 40 from the primary unclamped position to the primary clamped position in the absence of activation of the clamping means 42.

The retaining means 60 are preferably clamping means. The retaining means 60 are configured to cooperate with the retaining portion 82, for example. As can be seen in FIG. 2, the retaining means 60 include two flexible branches 112 adapted to grip the retaining portion 82, for example.

In a variant that is now shown, the retaining means 60 include a magnet adapted to exert a magnetic retaining force on the primary clamping mean 42 when the primary clamping plate is in its primary unclamped position.

The attachment members 62 of the insulating cap 26 are adapted to cooperate with the attachment element 70 to fix the cap 26 to the shell 22. In accordance with the FIG. 2 example, the attachment members 62 are configured to clip the cap 26 to the shell 22. For example, the attachment members 62 include at least one projection 114 in one piece with the shell 22. In a variant that is not shown, the attachment members 62 include one or more clipping holes.

The bearing portion 64 connects the primary tongue 66 to the secondary tongue 68. The bearing portion 64 is preferably perpendicular to the insertion direction X.

The bearing portion 64 is includes an opening 116 for passing the primary conductor 8 from the primary opening 52 as far as the primary unit 18 received in the primary chamber 48.

The primary tongue 66 is in contact with the primary unit 18. The primary tongue 66 is perpendicular to the bearing portion 64, for example. The primary tongue 66 is preferably directed toward the switching device 4. The primary tongue 66 is configured to be disposed between the primary clamping wall 74 and an input connection area 12 or an output connection area, for example. In FIG. 4, the primary tongue 66 is adapted to be sandwiched between the primary clamping wall 74 and the input area 12 or the output area.

The secondary tongue 68 is configured to be in electrical contact with a respective secondary conductor 28. The secondary tongue 68 is perpendicular to the bearing portion 64, for example. The secondary tongue 68 is preferably parallel to the primary tongue 66 and oriented in the opposite direction.

The bearing tongue 69 is configured to enable the link piece 24 to be held in position against the shell 22. In particular, the bearing tongue 69 is adapted to prevent movement in translation of the link piece 24 in the upward direction perpendicular to the insertion direction X. In FIG. 3, the bearing tongue 69 is inserted in the slide 104 of the insulating shell 22 to prevent movement in translation of the link piece 24 in the upward direction.

The attachment elements 70 are adapted to cooperate with the attachment members 62 to fix the cap 26 to the shell 22. The attachment elements 70 are clipping elements, for example. In accordance with the FIG. 2 example, the attachment elements 70 include clipping openings 118 adapted to receive attachment projections 114.

In a variant that is not shown, the attachment elements 70 include attachment projections adapted to cooperate with respective clipping holes in the shell 22.

The primary screwing wall 76 receives the primary clamping means 42. For example, the primary screwing wall 76 includes a threaded opening 120 adapted to cooperate with the threaded portion 80 to drive the movement in translation of the primary clamping plate 40.

The complementary opening 79 of the primary clamping plate 40 is adapted to cooperate with the end 84 of the primary clamping means 42 to drive the movement of the primary clamping plate 40 between the primary clamped position and the primary unclamped position.

The threaded portion 80 has a first diameter D1.

In FIGS. 2 and 3, the retaining portion 82 is threaded. The retaining portion 82 has a second diameter D2. The value of the second diameter D2 is equal to that of the first diameter D1, for example. In a variant that is not shown, the value of the second diameter D2 is greater than that of the first diameter D1.

By way of an optional addition, the retaining portion 82 has a non-threaded exterior surface. The retaining portion 82 preferably has a rough exterior surface facilitating the clamping by the retaining means 60.

The end 84 is configured to convert a movement of rotation of the primary clamping means 42 into a movement in translation of the primary clamping plate 40.

The secondary screwing wall 88 receives the secondary clamping means 46. For example, the secondary screwing wall 88 include a threaded opening 122 to receive the secondary clamping means 46.

The slide 104 is configured to receive the bearing tongue 69. The slide 104 is of parallelepiped shape, for example. The blocking tongue 106 is in one piece with the secondary cage 44. When the secondary cage 44 is in the clamping position, the blocking tongue 106 faces the secondary opening 54 and is therefore able to prevent the insertion of objects into the secondary chamber 50 via the secondary opening 54. In particular, the blocking tongue 106 is adapted to prevent the insertion of a respective secondary conductor into the secondary chamber 50 from the secondary opening 54 when the secondary cage 44 is in the secondary clamped position. The blocking tongue 106 is perpendicular to the secondary insertion direction, for example.

Each fixing rim 108 is adapted to be inserted in a respective slot 37 in the insertion direction X.

Each clipping projection 110 is adapted to cooperate with a respective clipping groove to limit the movement of the shell 22 in the insertion direction X.

The flexible branches 112 are in one piece with the shell 22, for example.

By way of an optional addition, the connecting device 6 includes a groove 126 to receive the retaining plate 36 for fixing the connecting device 6 to the switching device. The groove 126 extends in a transverse plane perpendicular to the insertion direction X.

The connecting device 6 therefore provides a simple way to connect a primary conductor 8 to an input connection area 12 or an output connection area of the electrical switching device 4 and the secondary conductor 28 to the primary conductor 8.

In the example of FIGS. 1 to 4, the connecting device 6 is easily fixed to the switching device 4 by inserting the fixing rims 108 into the corresponding slots 37 until the clipping projections 110 and the clipping grooves cooperate. The fixing is then finalized by inserting the retaining plate 36 into the fixing groove 126 and fixing the attachment portion 34 to the switching device 4, for example by screwing it to the latter.

As can be seen in FIG. 4, when the connecting device 6 is fixed to the switching device 4 in this way, the connection area 12 of the switching device 4 is in contact with the primary tongue 66.

After fixing the connecting device 6 to the switching device 4, the operator inserts the primary conductor 8 into the primary cage 38 through the primary opening 52 and then screws in the primary clamping means 42 to move the primary clamping plate 40 from the primary unclamped position to the primary clamped position. In doing so, the primary clamping plate 40 clamps the primary conductor 8 against the connection area 12, the connection area 12 itself being clamped against the primary tongue 66, the primary tongue 66 then being sandwiched between the connection area 12 and the primary clamping wall 74. Good electrical contact is then obtained between the connection area 12, the primary conductor 8 and the primary tongue 66 of the link piece 24.

Connecting the secondary conductor 28 is equally simple, because it suffices to insert the secondary conductor 28 into the secondary cage 44 through the secondary opening 54 and then to clamp up the secondary clamping means 46. The secondary clamping means 46 then drives the upward movement of the secondary cage 44 so as to clamp the secondary conductor 28 between the secondary tongue 68 and the secondary clamping wall 86.

The use of the link piece 24 and two separate connecting cages 38, 44 makes it possible to prevent the mechanical strength of the clamping of the primary conductor 8 in the primary cage 38 from being affected by placing the secondary conductor 28 in the secondary cage 44. It is moreover possible to connect the secondary conductor 28 without disconnecting the primary conductor 8 and more generally independently of the connection of the primary conductor 8 to the primary unit 18.

In the FIG. 1 example, switching appliance 2 includes six connecting devices 6 in accordance with the invention, each including a primary unit 18, a respective secondary unit 20, an insulating shell 22 and a link piece 24. The person skilled in the art will of course understand that the connecting device 6 alternatively includes a plurality of primary units 18, a plurality of respective secondary units 20 and a plurality of respective link parts 24, received in a single shell 22.

In a variant that is not shown, the connecting device 6 contains three primary units 18, three secondary units 20, three link pieces 24 and a single insulating shell 22. The three-phase switching appliance 2 then includes two such connecting devices 6, one for the input and one for the output.

The connecting device 6 is preferably shipped with the primary clamping means 42 in the primary unclamped position. The retaining means 60 limit unwanted movement of the primary clamping means toward the clamped position. This makes it possible to avoid the operator having to start by loosening the primary clamping plate 40 before inserting the primary conductor 8 and therefore enables a time saving for the operator.

The primary blocking means 53 prevent the insertion of an object having a diameter greater than 12.5 mm (such as a finger) into the primary opening 52. The connecting device therefore offers enhanced safety vis a vis the risk of electrocution of an operator. This makes it possible to assign the switching appliance 2 a protection index of IP 2. Should it prove necessary to insert a conductor of greater than 12.5 mm diameter into the primary opening 52, it is easy to remove the primary blocking means 53 by breaking them off, as they are preferably adapted to be broken off.

The blocking tongue 106 blocks the secondary opening 54 when the secondary cage 44 is in the secondary clamped position. The blocking tongue 106 therefore ensures that the insertion of the secondary conductor 28 is possible only when the secondary cage 44 is in the secondary unclamped position for receiving the secondary conductor 28. This makes it possible to prevent connections of poor quality resulting from the insertion of the secondary conductor 28 when the secondary cage 44 is not in the intended position.

It is therefore clear that the connecting device 6 enables a simple and durable connection of each primary conductor 8 to each connection area of the switching device 4 and of the secondary conductor 28 to the corresponding primary conductor 8. It also makes it possible to ensure good electrical insulation of the various conductive parts and to minimize the risk of electrocution of an operator.

The invention claimed is:

1. A connecting device for connecting an electrical conductor to an area for electrical connection of an electrical switching device, the switching device including an electrical switching module connected to the area for electrical connection and an auxiliary module, the connecting device being removable from the electrical switching device and comprising:

at least one primary connecting unit for electrically connecting a primary conductor to the area for connection;

an insulating shell receiving each primary connecting unit, adapted to insulate electrically each primary connecting unit from outside of the connecting device when the primary conductor is connected to the corresponding area for connection;

means for fixing the shell to the switching device;

at least one secondary unit for connecting a secondary electrical conductor adapted to supply electrical power to the auxiliary module; and for each secondary unit, an electrically conductive link piece connected between said secondary unit and a respective primary unit, the link piece including a primary connecting tongue and a secondary connecting tongue that are oriented in opposite directions, wherein the insulating shell further receives each secondary unit and each link piece and the insulating shell is adapted to insulate electrically each secondary unit from the outside of the connecting device when the secondary conductor is connected to the secondary unit.

2. The connecting device according to claim 1, wherein each primary unit includes a primary cage including a primary clamping wall and a primary mobile clamping plate adapted to clamp a respective primary conductor against the primary clamping wall.

3. The connecting device according to claim 2, wherein the primary cage includes primary clamping means for clamping the primary clamping plate, the primary clamping means being mobile between a primary unclamped position in which the primary conductor is mobile relative to the primary cage and a primary clamped position in which the primary clamping plate is configured to clamp the primary conductor against the primary clamping wall, and the connecting device further includes means for retaining the primary clamping means in the primary unclamped position in the absence of activation of the primary clamping means.

4. The connecting device according to claim 3, wherein the primary clamping means include a retaining portion co-operating with at least one flexible branch of the retaining means to retain the primary clamping means in their primary unclamped position.

5. The connecting device according to claim 4, wherein each secondary unit includes a secondary cage including a secondary clamping wall and secondary mobile clamping means adapted to damp their respective secondary conductor against the secondary clamping wall.

6. The connecting device according to claim 2, wherein each secondary unit includes a secondary cage including a secondary clamping wall and secondary mobile clamping means adapted to clamp their respective secondary conductor against the secondary clamping wall, the primary clamping plate and the secondary mobile clamping means are movable independently of each other.

7. The connecting device according to claim 5, wherein the link piece includes the primary connecting tongue adapted to be disposed between the primary conductor and the primary clamping wall and the secondary connecting tongue adapted to be disposed between the secondary conductor and the secondary mobile clamping means.

8. The connecting device according to claim 1, wherein each primary unit includes a primary opening configured to receive a respective primary conductor and primary blocking means for partially blocking the primary opening, the primary blocking means being adapted to prevent the insertion of objects having a section of greater than 12.5 mm diameter into the primary opening.

9. The connecting device according to claim 1, wherein each secondary unit includes a secondary opening configured to receive a respective secondary conductor and secondary blocking means for partially blocking the secondary opening.

10. The connecting device according to claim 9, wherein the secondary blocking means are mobile between a blocking position preventing the insertion of objects into the secondary opening and an open position enabling the insertion of objects into the secondary opening.

11. The connecting device according to claim 1, wherein the connecting device is manually removable from the electrical switching device.

12. An electrical switching appliance comprising an electrical switching device provided with at least one area for connecting an electrical conductor and the connecting device according to claim 1.

13. The electrical switching appliance according to claim 12, wherein the electrical switching device is a circuit-breaker.

14. The electrical switching appliance according to claim 12, wherein the switching device further includes an auxiliary module, the auxiliary module being electrically connected to the corresponding secondary unit via the corresponding secondary conductor.

15. A connecting device for connecting an electrical conductor to an area for electrical connection of an electrical switching device, the switching device including an electrical switching module connected to the area for electrical connection and an auxiliary module, the connecting device being removable from the electrical switching device and comprising:

a primary connector to electrically connect a primary conductor to the area for connection;

an insulating shell to receive the primary connector, insulate electrically the primary connector from outside of the connecting device when the primary conductor is connected to the corresponding area for connection;

a fixing member to fix the shell to the switching device;

a secondary connector to connect a secondary electrical conductor that supplies electrical power to the auxiliary module; and for the secondary connector, an electrically conductive link piece connected between the secondary connector and a respective primary connector, the link piece including a primary connecting tongue and a secondary connecting tongue that are oriented in opposite directions, wherein the insulating shell further receives the secondary connector and the link piece, and the insulating shell is adapted to insulate electrically the secondary connector from the outside of the connecting device when the secondary conductor is connected to the secondary connector.

* * * * *